US006739717B2

(12) United States Patent
Hetzer et al.

(10) Patent No.: US 6,739,717 B2
(45) Date of Patent: May 25, 2004

(54) SECURITY CHASSIS

(75) Inventors: Ulrich Hetzer, Berlin (DE); Uwe Hübler, Neuenhagen (DE)

(73) Assignee: Francotyp-Postalia AG & Co. KG, Birkenwerder (DE)

( * ) Notice: Subject to any disclaimer, the term of this patent is extended or adjusted under 35 U.S.C. 154(b) by 0 days.

(21) Appl. No.: 10/320,128

(22) Filed: Dec. 16, 2002

(65) Prior Publication Data

US 2003/0112314 A1 Jun. 19, 2003

(30) Foreign Application Priority Data

Dec. 15, 2001 (DE) ..... 101 64 526

(51) Int. Cl.[7] ..... B41J 29/13
(52) U.S. Cl. ..... 347/108
(58) Field of Search ..... 347/104, 108; 101/91, 71

(56) References Cited

U.S. PATENT DOCUMENTS 4,767,228 A 8/1988 Harry
5,170,705 A * 12/1992 Haroutel ..... 101/91
5,427,023 A * 6/1995 Privin ..... 101/91
5,657,689 A * 8/1997 Lee ..... 101/91
6,041,704 A 3/2000 Pauschinger
6,102,534 A 8/2000 Herbert

FOREIGN PATENT DOCUMENTS

DE 40 33 999 C2 4/1992
EP 0 875 861 A2 11/1998
EP 1 024 682 A2 8/2000

* cited by examiner

*Primary Examiner*—Stephen Meier
*Assistant Examiner*—An H. Do
(74) *Attorney, Agent, or Firm*—Laurence A. Greenberg; Werner H. Stemer; Ralph E. Locher

(57) ABSTRACT

A security chassis for a secure area in the interior of a secure housing having a supporting frame for the printing mechanism in the non-secure area, a printing module being arranged such that it can move in the supporting frame and being protected mechanically against unauthorized access. The supporting frame is supported on at least one functional edge of at least one chassis shell, and at least two mutually spaced chassis shells surround the secure area. The at least one functional edge has ventilation openings formed at its margin. The geometric shape of the edge of the functional edge making penetration of tools into the secure area enclosed by the two chassis shells impossible.

7 Claims, 5 Drawing Sheets

SECURITY CHASSIS

BACKGROUND OF THE INVENTION

Field of the Invention

The invention relates to a security chassis for a secure area in the interior of a security housing. The configuration has a supporting frame for the printing mechanism in the non-secure area, a printing module being arranged such that it can move in the supporting frame and being protected mechanically against unauthorized access. The invention is suitable for devices which have an internal secure area and from which excess heat is to be dissipated. It is used in particular in franking machines, addressing machines and other mail-processing devices.

A thermal transfer franking machine distributed by Francotyp-Postalia of Germany, the assignee of this application, under the designation T1000 has a thermal transfer print head arranged permanently in the housing for printing a franking stamp. The franking stamp contains postal information previously entered and stored, including the postal charge data for the carriage of the letter. A compartment fitted to the housing is used to accommodate a replaceable ink-ribbon cassette (U.S. Pat. No. 4,767,228). While a door leading to the compartment can be opened at any time, access to the secure area of the printing device is prevented by a security housing.

If a franking machine is to be opened for repair purposes, break-off screws belonging to the security housing have to be destroyed. In franking machines and other mail-processing devices having a security housing, lead seals or plastic parts may additionally be used as a further protection against access to the microprocessor controller and to the control lines of the stationary print head. Following a repair which requires the security housing to be opened, break-off screws belonging to the security housing, lead seals or the plastic parts serving to prevent access must be replaced.

The JetMail® franking machine of Francotyp-Postalia is equipped with a base and a removable meter. Only the latter is protected against misuse by an appropriately designed housing. As distinct from this, the housing of the base, which contains a mail transport device and an inkjet printing device, does not have to have any protective function and can be of repair-friendly design. Since the ink reservoir of the print head is arranged separately and can be replaced, replacement of the print head is dispensed with. In addition, no special security measures for the print head or to protect the drive and data signals have to be taken if, using a specific piezoelectric inkjet print head, a security stamp with a mark is printed which permits rechecking of the authenticity of the security stamp (U.S. Pat. No. 6,041,704).

Inkjet print heads have also already been used in the printing module in franking machines having a security housing, that is to say without a separate housing for base and separable meter (for example, in mymail® of Francotyp-Postalia, in Personal Post™ of Pitney Bowes, and the PortoStar of Neopost). An ink reservoir and a bubble jet print head are integrated into a replaceable ink cartridge, as previously known, for example, from the half-inch ink cartridges of Hewlett Packard. However, it must be possible for a hatch in the security housing to be opened by the user in order to remove or replace an empty ink cartridge. Because of the access to the printing mechanism which is therefore made possible and, possibly, to the printer electronics or making contact with the ink cartridge, the result may be new possibilities for producing an unauthentic security stamp. Some postal authorities place strict requirements on the approval of franking machines, which makes their producers equip such ink cartridges with additional security means or take suitable protective measures, so that influence can be exerted neither indirectly via manipulated ink cartridges or directly on the printing operation in order to print franking stamps without paying for them.

In addition to the purely electronic solutions, solutions are already known which mechanically prevent a further printing device being controlled impermissibly with the printing data during the printing operation. According to U.S. Pat. No. 6,102,534 or published European patent application EP 875 861 A2, a franking machine for franking printing can be operated only when a hatch is closed. However, the hatch must continue to be open in order to remove or replace an empty ink cartridge. A secure area in the interior of the device housing is not particularly protected in any of the aforementioned solutions.

European patent application EP 1 024 682 A2 discloses a security housing which comprises two housing shells, their side walls overlapping one another in the assembled state. The two housing shells enclose the inner secure area having a circuit board on which a controller is constructed. However, no dissipation of heat by means of forced convection is provided. However, if ventilation slots were to be provided for heat dissipation, then the inner area would either have to be viewed as no longer secured or the production costs of the housing shells would become unacceptably high.

However, the user of a franking machine is to continue to be provided with the possibility of removing or replacing an ink cartridge without there being a possibility for manipulation through an opening required for this purpose, in order to penetrate into the inner secure area.

SUMMARY OF THE INVENTION

It is accordingly an object of the invention to provide a security chassis, which overcomes the above-mentioned disadvantages of the heretofore-known devices and methods of this general type and which provides for a housing construction with internal chassis parts that cover the inner secure area and permit heat dissipation by means of forced convection of the air stream to the outside, with low production costs.

With the foregoing and other objects in view there is provided, in accordance with the invention, a security chassis for the secure area in the interior of the security housing, the security housing having an interior with a secure area and a non-secure area and a printing mechanism disposed therein. The configuration comprises:

at least two mutually spaced-apart chassis shells enclosing the secure area, one of the chassis shells having a functional edge;

a supporting frame for the printing mechanism in the non-secure area supported on the functional edge of the one chassis shell, and a printing module movably disposed in the supporting frame and protected mechanically against unauthorized access;

the functional edge having ventilation openings formed in a margin thereof, the margin of the functional edge and the ventilation openings having a geometric shape rendering penetration of tools into the secure area enclosed by the at least two chassis shells substantially impossible.

In accordance with an added feature of the invention, the ventilation openings at the margin of the functional edges are formed in mutually offset rows.

In accordance with an additional feature of the invention, the chassis shells include a first chassis shell having an edge formed with ventilation openings and a second chassis shell spaced apart from the first chassis shell formed with ventilation openings at the margin of the functional edges thereof.

In accordance with another feature of the invention, the margins of the chassis shells wrap around one another and are shaped at an angle rendering impossible a penetration of tools.

In accordance with a further feature of the invention, at least one of the functional edges is configured in an L shape.

In accordance with again a further feature of the invention, at least one of the functional edges of at least one of the chassis shells is configured in a U shape or an inverted U shape.

In accordance with a concomitant feature of the invention, the offset between the rows is configured only to render impossible a penetration of tools into the secure area along a rectilinear path.

In other words, inside the security housing there is at least one secure area and at least one non-secure area. Only authorized persons, such as service engineers, are authorized to make access to both areas and may open the security housing. By means of a housing construction with internal chassis parts, the secure area in the interior of the security housing is protected against unauthorized access. At least two chassis shells spaced apart from each other surround the secure area. A supporting frame for the printing mechanism in the non-secure area is supported on at least one functional edge of at least one chassis shell. A printing module is arranged such that it can move in the supporting frame and is protected mechanically against unauthorized access. In this case, the starting point is the thought that the mutually spaced functional edges have ventilation openings formed at their edge, the geometric shape of the edge of the functional edges making penetration of tools into the secure area enclosed by the two chassis shells impossible. Provision is made for the ventilation openings at the edge of the functional edges to be arranged in the form of mutually offset rows, the offset being only such that penetration of tools into the secure area on a rectilinear path is made impossible. Ventilation openings are arranged at the edge of a first chassis shell and at the edge of functional edges of a second chassis shell spaced apart from the first. The edges of the chassis shells, which wrap around each other, are, at the same time, shaped at an angle which makes penetration of tools impossible, at least one of the functional edges of at least one of the chassis shells being configured in a U shape or in an inverted ∩ shape or L shape. As a result of this design, the weight and the forces acting in the printing mechanism are dissipated via the supporting frame onto the upper chassis shell and from the latter via the lower chassis shell onto the lower housing part. The printing mechanism is advantageously easily accessible for service and for the ink cartridge change, and good dissipation of heat is ensured, nevertheless chassis parts cover the inner secure area.

Other features which are considered as characteristic for the invention are set forth in the appended claims.

Although the invention is illustrated and described herein as embodied in a security chassis, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
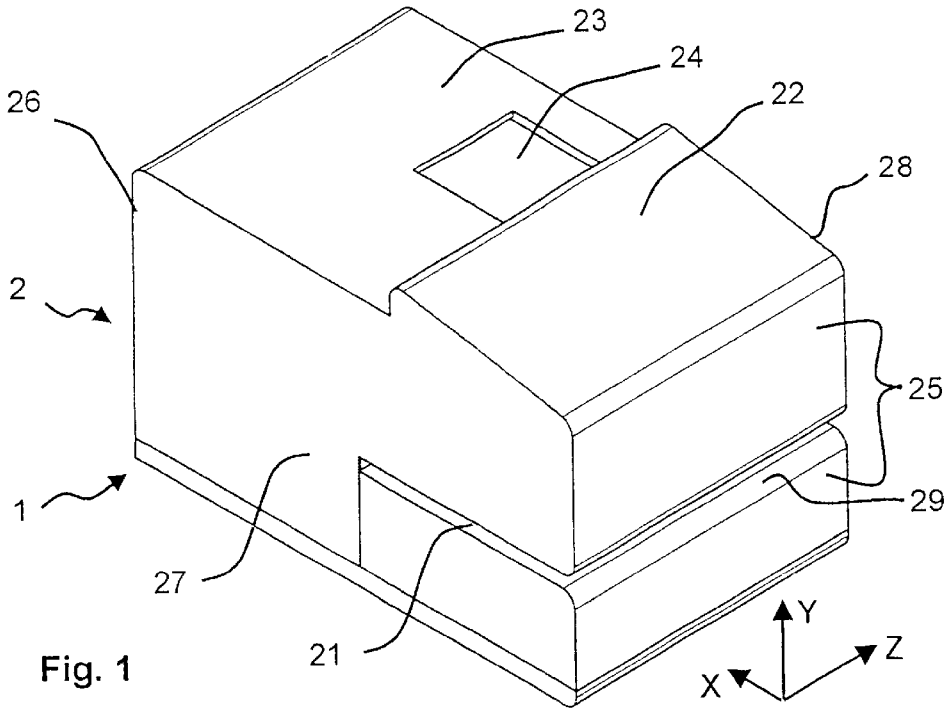
FIG. 1 is a perspective view of a franking machine.

Referring now to the figures of the drawing in detail and first, particularly, to the perspective view of FIG. 1, there is shown a franking machine having a removable upper housing part 2, which is arranged in the Y-direction above a lower housing part 1. The franking machine has a divided front side 25. The front side 25, the mail inlet side 27 and the mail outlet side 28 (not visible) of the upper housing part 2 have a slot-like opening 21 for an item of mail to be franked. The mail item can be fed in along a Z direction. Underneath the opening 21 there is a separately removable housing part 29, formed with a letter running surface. The housing upper side has a surface 22 which is inclined toward the front side 25 and which is suitable for accommodating a non-illustrated user interface. On the housing upper side 23, which adjoins the inclined housing upper surface 22 in the X direction and which is bounded by a housing rear side 26, an opening 24 is arranged. For the user, a flap is provided—not shown in FIG. 1—which covers the aforementioned opening 24 and can be opened or taken off at any time. Following the input of an unauthorized signal, a printing module is moved into a position adjacent to the printing position, from which an ink cartridge can be removed or replaced. Only a person authorized to do it, for example a service engineer, may remove further housing parts. Following removal of the lower housing part 1 and the upper housing part 2, a chassis configuration remains which has a number of chassis parts arranged in the Y direction above a lower housing part 1.

Figure 2:
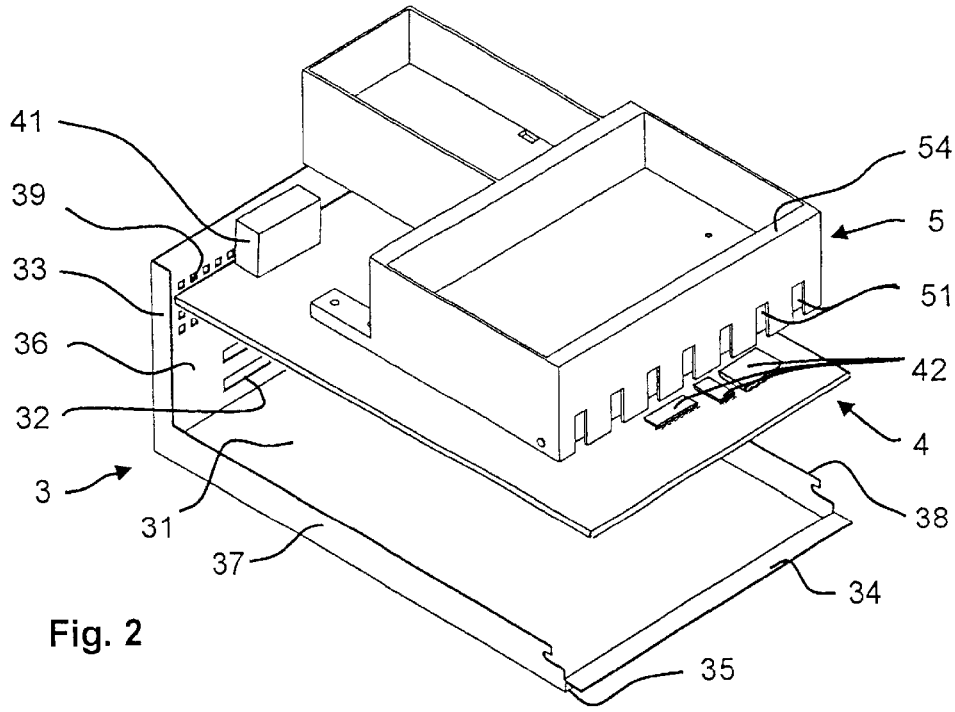
FIG. 2 is a perspective view of a chassis configuration according to the invention.

FIG. 2 shows a perspective view of a chassis configuration in an exploded illustration, said arrangement protecting an internal secure area mechanically but permitting dissipation of heat to the outside by means of the forced convection of an air stream. Arranged above a lower shell 3 shaped for protective and supporting purposes and a printed circuit board 4, on which the components of the inner secure area are wired together, is an upper shell 5, which is shaped appropriately for protective and supporting purposes. The upper shell 5 has a group 51 of external ventilation openings which are arranged in a row and are preferably incorporated in the manner of slots at the margin, i.e., the outer edge.

The lower shell 3 comprises a shielding and supporting plate 31 parallel to the lower housing part 1 and a rear shielding and supporting sheet-metal part 36 which is bent over parallel to the housing rear side 26 and which has at least one opening 39 for discharging a heated air stream to the outside. At least one component 41 is arranged in the Y direction above the printed circuit board 4 and is accessible through an opening 32 in the angled rear shielding and supporting sheet-metal part 36. The aforementioned externally accessible component 41 is, for example, a socket for a plug-in mains cable. At least one group 42 of components (only partially visible) is arranged above the printed circuit board 4 in the Y direction and can be concealed in a manner secure against manipulation by the upper shell 5 which can be placed above them. A further group of components (not visible) on the underside of the printed circuit board 4 is hidden by the lower shell 3 in the manner of a box in the assembled state. The aforementioned group 42 of components and the further group of components (not visible) on the underside of the printed circuit board are therefore arranged to be completely inaccessible from outside and belong to the inner secure area. The shielding and supporting metal sheet 31 lies parallel to the xz plane and, for this purpose, has, at its side edges, side edge surfaces 37 and 38 which are angled over toward the mail inlet side 27 and toward the mail outlet side 28, respectively, and at the same time run parallel to the xy plane. The rear shielding and supporting sheet-metal part 36 lies parallel to the yz plane and, at the side edges, has side edge surfaces 33 and 34 (not visible) which are angled over toward the mail inlet side 27 and toward the mail outlet side 28, respectively, and at the same time run parallel to the xy plane. The lower shell 3 has a front side sheet-metal part 35 which is angled over from the shielding and supporting metal sheet 31 and parallel to the housing front side 25 and, at the same time, as far as its functional edge, runs parallel to the yz plane and which has a skirt 34 running parallel to the xz plane. The transition to the aforementioned skirt 34 of the lower shell 3 is in this case one functional edge of the lower shell 3 which, in the assembled state, is spaced apart from the other functional edge 54 of the upper shell 5.

Figure 3:
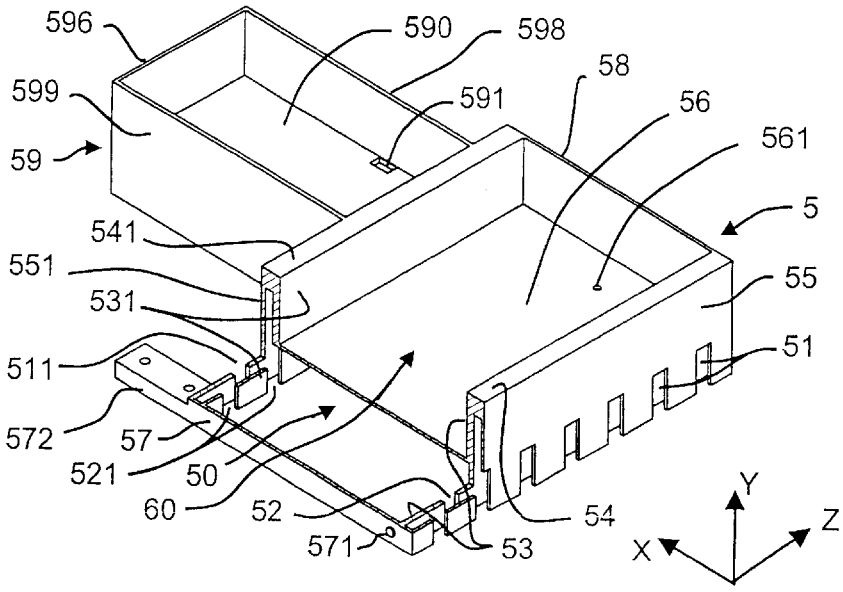
FIG. 3 is a perspective view of an upper chassis shell.

FIG. 3 shows a perspective view of the upper chassis shell 5 which is illustrated cut open on one side in order to make visible a second group 52 of inner ventilation openings which are arranged in a row and which are preferably incorporated in the manner of slots close to the functional edge 54 on an inner side wall 53 arranged close to the front side. The upper chassis shell 5 is bounded toward the front side by the functional edge 54 and toward the rear side by a functional edge 541 parallel thereto. The functional edge 54 of one upper chassis shell 5 is configured in an inverted U shape, that is to say ∩ shape, in order to form at the edge a first group 51 of ventilation openings on the outer front side wall 55 and a (partially visible) second group 52 of ventilation openings on the inner side wall 53, the two groups 51 and 52 of ventilation openings being arranged close to the functional edges and offset in relation to one another only to such an extent to prevent penetration into the inner area on a rectilinear path. The upper chassis shell 5 has a second functional edge 541 which is offset in the X direction and parallel to the first functional edge 54, which is likewise configured in an inverted U shape, that is to say ∩ shape, in order to form at the edge a first group 511 of ventilation openings on the side wall 551 lying on the outside in the X direction and a (partially visible) second group 521 of ventilation openings on the inner side wall 531. A side wall 57 and 58—illustrated cut open—bounds the upper chassis shell 5 on the mail stream inlet and mail stream outlet side, respectively. A cavity located on the inside is divided by a plate 56 lying parallel to the shielding and supporting metal sheet 31 into a lower cavity 50 and an upper cavity 60. The lower cavity 50 is provided to accommodate accounting and control electronics for printing and belongs to the inner secure area. The upper cavity 60 is provided to accommodate a printing mechanism. In addition, a box 59 can be arranged on the upper chassis shell 5, said box extending in the X direction, for example, as far as the box rear wall 596 and being bounded in the Z direction, that is to say downstream in the mail stream, by a box side wall 598 and, opposed to this, that is to say upstream in the mail stream, by a box side wall 599. If the box 59, as shown, has a box base 590, then at least one opening 591 for electrical cables is provided in the latter. The box 59 has, for example, a greater length in the X direction as far as the box rear wall 596 than in the Z direction. The box side wall 599 is arranged at the center of the length in the Z direction on the outer side wall 55', all the walls preferably having an identical height in the Y direction. A side wall 57—shown cut open—and the side wall 58 are equipped with fixing means 571 and 572 and—not visible—fixing means 581 and 582, in order to fix the upper chassis shell 5 to the lower chassis shell 3 on the mail stream outlet side.

Figure 4:
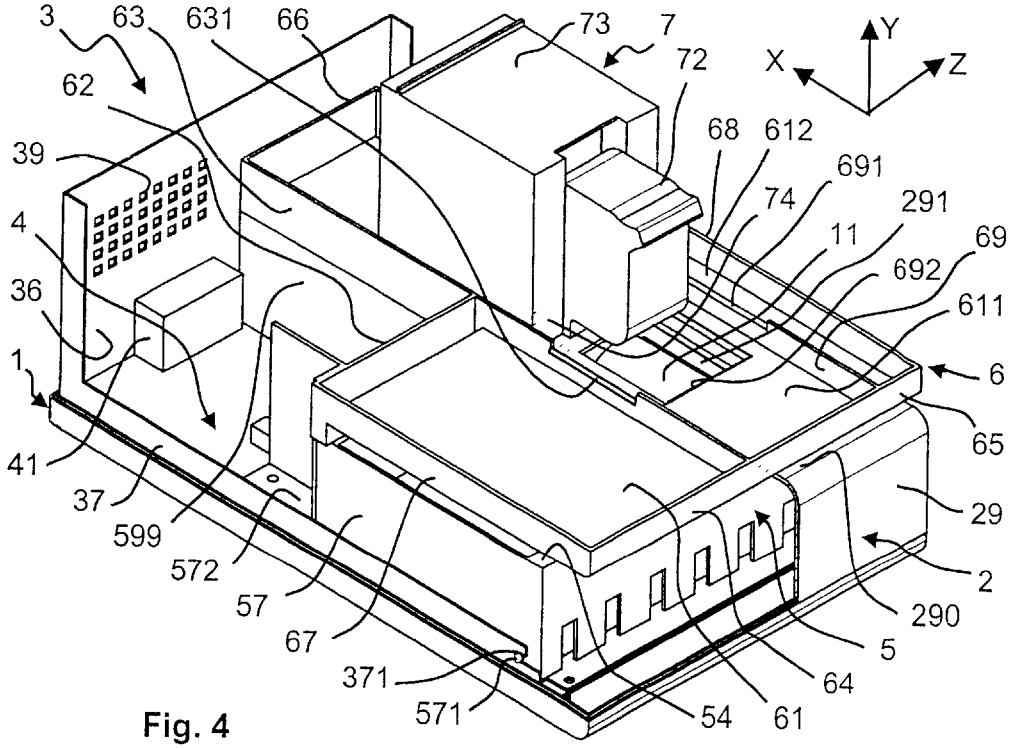
FIG. 4 is a perspective view of mounted chassis parts.
Figure 8:
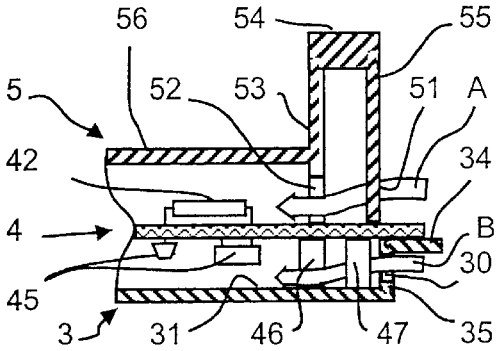
FIG. 8 is a side view of the chassis configuration according to FIG. 2.

FIG. 4 shows a perspective view of mounted chassis parts 3, 4, 5 and 6. In the assembled state, the printed circuit board 4 populated with components from the groups 42 and 45 rests with its front side on the skirt 34 of the lower shell 3 (FIG. 8). The upper chassis shell 5 is supported by its side walls on the printed circuit board 4, a supporting frame 6 for supporting the printing mechanism being arranged above its functional edges 54, 541 as a further chassis part. The supporting frame 6 is bounded on the mail stream inlet side and mail stream outlet side by side walls 67 and 68, respectively. The supporting frame 6 has a length in the Z direction from the one side wall 67 to the other 68, which is divided centrally by a dividing wall 63 into two rectangular boxes, that is to say into a box placed on the mail stream inlet side and having a first base area and into a box placed on the mail stream outlet side and having a second base area, the box placed on the mail stream inlet side having a smaller base area than the box placed on the mail stream outlet side. The box placed on the mail stream inlet side is bounded by a rear side wall 62 placed in the X direction, the dividing wall 63, a front side wall 64 and the side wall 67, and has a base plate 61 with the first base area. In the X direction, the dividing wall 63 merges into a side wall of the box placed on the mail stream outlet side, the side wall being aligned with the side wall 599 of the box 59 arranged underneath. The box arranged above additionally has a front side wall 65 and a rear side wall 66 placed in the X direction. All the aforementioned walls 62, 63, 64, 65, 66, 67 and 68 are illustrated cut open vertically, in order to make parts of the printing mechanism visible. An item of mail (not shown) is transported in the transport direction Z by a driven transport drum (shown in FIG. 5), which is arranged opposite at least one sprung opposing roller 11. The opposing roller 11, which can be seen in a window-like opening 291 of a letter running surface 290 of the separately removable housing part 29, is not driven. A plate belonging to the housing part 29 and having the letter running surface 290 is supported on the first functional edge 54 of the upper chassis shell 5. A printing module 7 has a protective cap 73 and carries at least one replaceable ink cartridge 72, which can be fixed to a printing carriage 74. During printing, a filled envelope is moved in the transport direction Z at a predetermined speed by means of a transport drum that projects through an opening 692 in a base plate 611 of the supporting frame 6. The box placed on the mail stream outlet side has, parallel to the dividing wall 63, a further dividing wall 69 extending in the X direction in order to limit the base plate 611 in the Z direction. In the vicinity of the printing position, both dividing walls 63, 69 have openings 631, 691 spaced apart and opposite each other in the Z direction for the transport drum. Between the dividing wall 69 and the side wall 68 on the mail stream outlet side, a further base plate 612 can be arranged at the same level as the base plate 61, through which further base plate 612 an item of mail to be franked, which is pushed in a manner not shown into the slot-shaped opening 21—shown in FIG. 1—in the upper housing part 2, that is to say is fed in in the Z direction, is bounded in its thickness in the Y direction from the letter running surface 290.

The side wall 57 and the side wall 58—not illustrated—are equipped with bolts 571 and 581 (not visible) as fixing means. The bolt is rotatably mounted in a bearing opening 371 or 381 (not visible) of the side edge surfaces 37 and 38 (not visible), around which the upper chassis shell 5 can be rotated if the other fixing means 572 and 582 (not visible) are released. The normal fixing means are break-off screws or lead-sealed screws.

The secure area protected in this way can internally have a further high secure area. Encapsulating the high secure area by means of a further housing provides additional mechanical protection. For franking machines, a security module for such a high secure area has been developed which is equipped with an accounting unit, with a cryptographic unit for securing the postal charge data to be printed and with its own security housing.

The lower chassis shell 3 has ventilation openings 39 in the rear shielding and supporting sheet-metal part 36 and, possibly, ventilation openings (not shown) in the printed circuit board 4 close to the component 41.

Figure 5:
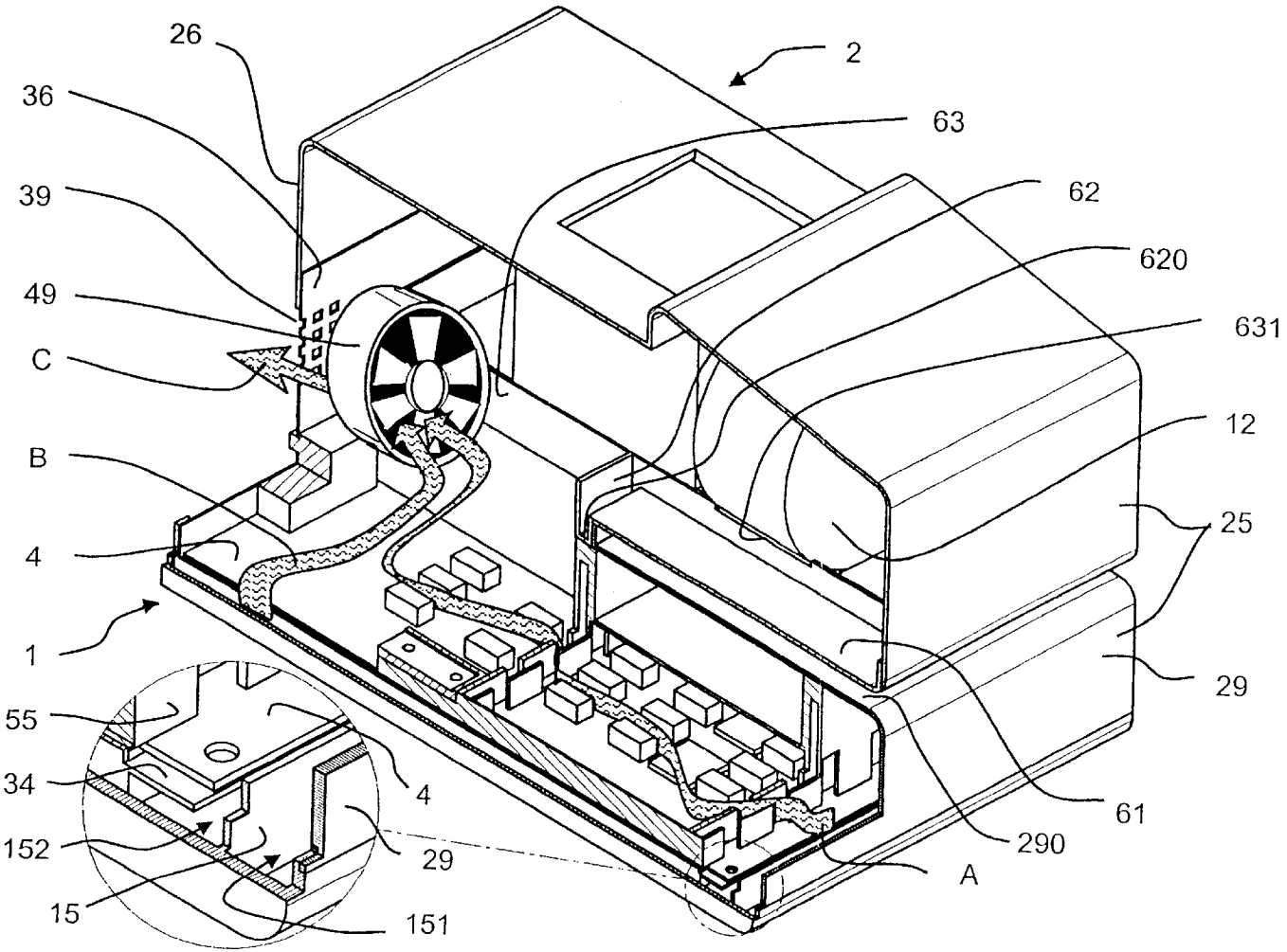
FIG. 5 is a perspective view from the left of a cut-open franking machine.

By using a perspective view, shown in FIG. 5, of a franking machine cut open from the left, the air guidance needed to cool the components will be illustrated. The upper housing part 2 and housing part 29, the lower chassis shell 3, the upper chassis shell 5 and the box placed on the mail stream inlet side and belonging to the chassis part 6 are illustrated cut open. Therefore, the plate with the letter running surface 290, the base plate 61, the rear side wall 62 with a U-shaped channel 620, the dividing wall 63 with an opening 631 for the transport drum 12 are at least partly visible in terms of their arrangement in relation to one another. The housing part 29 of the upper housing part 2, which is arranged above a lower housing part 1 in the Y direction, has at least one first channel 151 for air guidance A to the first group 51 of air openings in the side wall 55 of the upper chassis shell 5, the channel 151 being formed by a dividing wall 15 parallel to the front side and by the housing part 29. At the front side, the dividing wall 15 is formed on the inside of the lower housing part 1 and extends in the Z direction. The air stream is taken in by a fan 49, the components of the printed circuit board 4 in the secure area having flow around them. The air stream exits through the second group 511 of ventilation openings in the upper chassis shell 5 and reaches the fan 49, which forces the waste air C through the ventilation openings 39 in the rear shielding and supporting sheet-metal part 36. A second air stream B flows laterally around the printed circuit board 4 or flows through openings—not shown—in the latter and likewise reaches the fan 49. The air is fed in via a second channel 152 to a further group 30—shown in FIG. 7—of ventilation openings in the front side sheet-metal part 35 of the lower chassis shell 3, the channel 152 being formed by the front side sheet-metal part 35 of the lower chassis shell 3 and the parallel dividing wall 15. The skirt 34 of the lower chassis shell 3 or a corresponding part of the printed circuit board 4 reaches as far as the dividing wall 15 and bounds the second channel 151 at the top, that is to say in the Y direction. The lower housing part 1 bounds both channels 151, 152 at the bottom. The housing rear side 26 is formed in a suitable way to carry away an air stream C heated by the power loss to be dissipated from the components and is provided with suitable plug-in connector sockets in order to accommodate plug-in mains connecting cables and telephone and interface cables, and so on.

Figure 6:
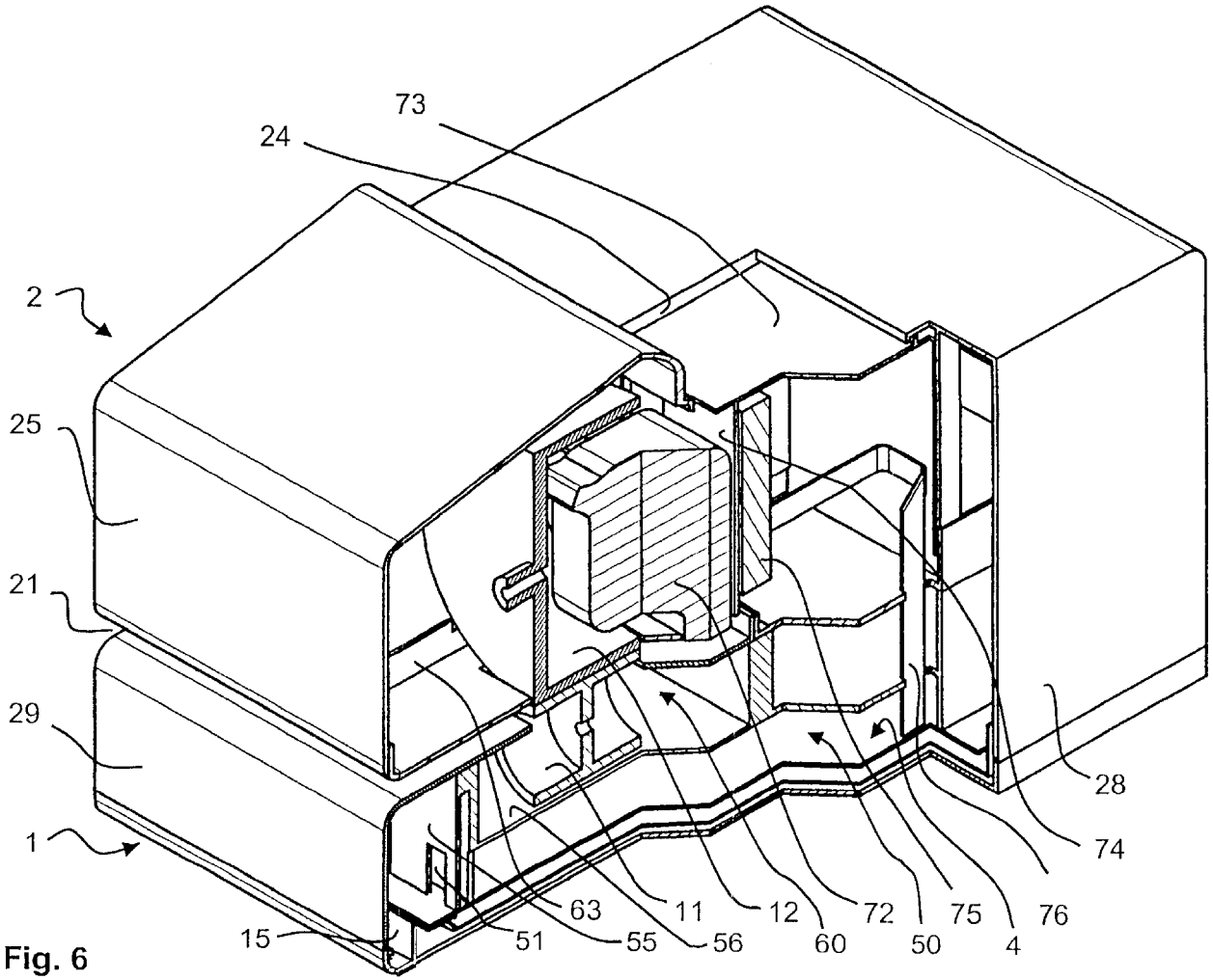
FIG. 6 is a perspective view from the right of a cut-open franking machine.

FIG. 6 shows a perspective view from the right of a cut-open franking machine, with the upper housing part 2 with the slot 21 for feeding mail in on the side wall—not visible—on the mail inlet side, and with the side wall 28 on the mail outlet side, with the housing part 29 on the front side 25 of the upper housing part 2, with the dividing wall 15 on the lower housing part 1, with the group 51 of openings in the front side wall 55 of the upper chassis shell 5, with the dividing wall 63, with the at least one replaceable ink cartridge 72, with the transport drum 12 and the at least one opposing roller 11 in their arrangement in relation to one another, the latter being arranged in the space 60 in the upper chassis shell 5 which is separated by the base plate 56 from the space 50 for the components arranged on the printed circuit board 4 in the secure area. The printing module, arranged such that it can move transversely with respect to the transport direction Z, has a printing carriage 74 in addition to the at least one replaceable ink cartridge 72, which in the printing position projects to some extent into the transport drum 73. More detailed explanations relating to this can be taken from the German patent application 100 32 855.5, which does not form a prior publication, which bears the title: Device for printing on a printing medium.

If the printing carriage 74 is brought into a printing position in order to print using the at least one replaceable ink cartridge 72, the protective cap 73 prevents access to the control lines 76 or printer control electronics 75 during printing. The protective cap 73 is fixed to the printing carriage 74 and closes the aforementioned opening 24 in the housing, corresponding to the movement of the printing carriage in the direction of the printing position. In any other position into which the printing carriage can be brought, the aforementioned opening is not closed or not completely closed by the protective cap. More detailed explanations relating to this can be taken from the German patent application 101 49 210.3, which does not form a prior publication, which bears the title: Method and arrangement for opening a security housing.

Figure 7:
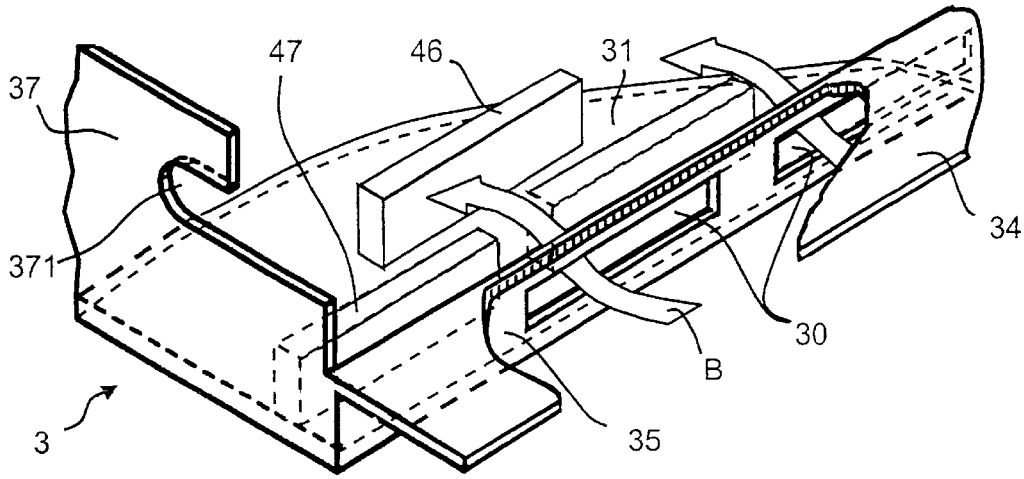
FIG. 7 is a perspective view of a detail of a lower chassis shell.

FIG. 7 shows a perspective view of a detail of a lower chassis shell 3. The air from an air stream B is fed in from the second channel under the skirt 34 of the lower chassis shell 3 to the second group 30 of ventilation openings in the front side sheet-metal part 35 of the lower chassis shell 3. In the vicinity of the front side sheet-metal part 35, the respective side edge surface 37 or 38 (not visible) of the lower chassis shell 3 has, for example, bearing openings 371 and 381 (not visible) as fixing means for the upper chassis shell 5. Spacers 46, 47, on which an appropriate part of the printed circuit board 4 is supported, can advantageously also be used to guide air over the surface of the printed circuit board 4.

FIG. 8 shows a side view of the chassis configuration according to FIG. 2, only one 54 of the two functional edges 54, 54' of at least two chassis shells 3 and 5 spaced apart from each other being illustrated. Formed on their respective edges are ventilation openings 30, 51, 52, the geometric shape of the edge of the functional edges making penetration of tools into the secure area enclosed by the two chassis shells impossible. The edge of the functional edges is formed in a ∩-shape, the result being an inner side wall 53 and an outer side wall 55.

Provision is preferably made for the ventilation openings 51, 52 at the edge of the functional edges to be arranged in the form of mutually offset rows. The air stream A flows through the aforementioned ventilation openings 51, 52 at the edge of the functional edges and flows around electronic components which are arranged on a printed circuit board 4 in the secure area and are wired to one another. The internal space enclosed above the printed circuit board is limited in terms of height by a plate 56 belonging to the chassis shell 5 and is intended to accommodate components 42. The internal space enclosed underneath the printed circuit board 4 is limited in terms of height by a shielding and supporting metal sheet 31 belonging to the chassis shell 5 and is intended to accommodate components 45. Additional spacers 46, 47 arranged on the shielding and supporting metal sheet 31 have a spacing and air-guiding function. The air stream B flows through the aforementioned ventilation openings 30 and flows around electronic components 45 in the internal space belonging to the secure area and enclosed underneath the printed circuit board 4. For improved dissipation of power losses and in order to comply with EMC standards, the lower chassis shell 3, 3', 3" is produced from a metal plate which is highly conductive both thermally and electrically.

Figure 9:
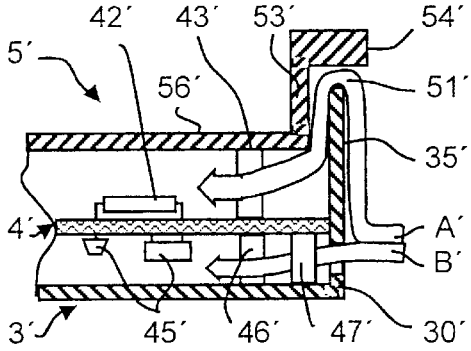
FIG. 9 is a side view of an alternative chassis configuration.

FIG. 9 shows a side view of an alternative chassis configuration, which differs from the preferred variant according to FIG. 8 in the edge design and shape of the chassis shells 3' and 5'. Ventilation openings 51' are provided at the edge of functional edges 54' of at least two mutually spaced chassis shells 3' and 5' having L-shaped functional edges, the result being an inner side wall 53'. An outer side wall for the chassis shell 5' is dispensed with. Its function is performed by a lengthened front side sheet-metal part 35 of the lower chassis shell 3', which has openings 51' for the air stream A'. The chassis shell 5' is supported on the printed circuit board 4 via a spacer 43'. The edges of each of the chassis shells 3' and 5' are angled over at an angle of 90° and wrap around each other, a spacer 43' maintaining a distance between the edges, which makes penetration of tools impossible. A skirt 34, as shown in FIG. 8, is dispensed with in this case, and both air streams A', B' are taken from a common channel.

Figure 10:
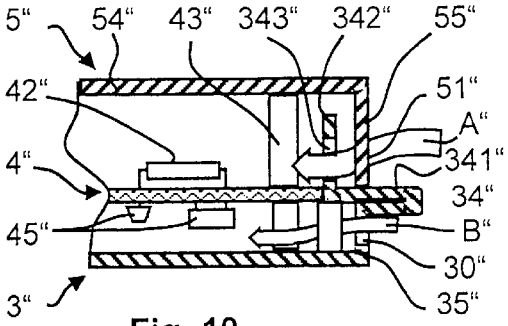
FIG. 10 is a side view of a further alternative chassis configuration.

FIG. 10 shows a side view of a further alternative chassis configuration, which differs from the preferred variants according to FIGS. 8 and 9 by the edge design and shape of the chassis shells 3" and 5". Provision is made for at least two mutually spaced chassis parts and at least L-shaped functional edges to have ventilation openings at their edge, the ventilation openings of the functional edges of the at least two mutually spaced chassis shells being arranged to be offset in relation to one another. Provision is made for the edges of the chassis shells 3" and 5" to wrap around each other and, in the process, to be shaped at an angle which makes penetration of tools impossible. For example, the edges of each of the chassis shells are angled over at an angle of 90° and wrap around each other, a spacer 43" maintaining a distance between the edges, which makes penetration of tools impossible. The internal space enclosed above the printed circuit board, which is limited in terms of height by a plate 56" belonging to the chassis shell 5", becomes a maximum if the plate 56" lies at the same level as the functional edge 54" and merges seamlessly into such an edge or is equal to the functional edge 54".

It will be readily understood that the invention is not restricted to the exemplary embodiment. A large number of alternative chassis configurations are conceivable within the scope of the claims, the aforementioned functional edges being designed differently in terms of shape and having ventilation openings at their edge with a more or less labyrinth-like edge structure, so that penetration of tools on a rectilinear path is made impossible. It is thus obvious that further different embodiments of the invention can be developed and used which are based on the same basic ideas of the invention and are covered by the appended claims.

We claim:

1. In a security housing having an interior with a secure area and a non-secure area and a printing mechanism disposed therein, a security chassis for the secure area in the interior of the security housing, comprising:

at least two mutually spaced-apart chassis shells enclosing the secure area, one of said chassis shells having a functional edge;

a supporting frame for the printing mechanism in the non-secure area supported on said functional edge of said one chassis shell, and a printing module movably disposed in said supporting frame and protected mechanically against unauthorized access;

said functional edge having ventilation openings formed in a margin thereof, said margin of said functional edge and said ventilation openings having a geometric shape rendering penetration of tools into the secure area enclosed by said at least two chassis shells substantially impossible.

2. The security chassis according to claim 1, wherein said ventilation openings at said margin of said functional edges are formed in mutually offset rows.

3. The security chassis according to claim 1, wherein said chassis shells include a first chassis shell having an edge formed with ventilation openings and a second chassis shell spaced apart from said first chassis shell formed with ventilation openings at the margin of said functional edges thereof.

4. The security chassis according to claim 1, wherein said margins of said chassis shells wrap around each other and are shaped at an angle rendering impossible a penetration of tools.

5. The security chassis according to claim 1, wherein at least one of said functional edges is configured in an L shape.

6. The security chassis according to claim 1, wherein at least one of said functional edges of at least one of said chassis shells is configured in a U shape or an inverted U shape.

7. The security chassis according to claim 2, wherein the offset between said rows is configured only to render impossible a penetration of tools into the secure area along a rectilinear path.

* * * * *